US006128438A

United States Patent [19]

Kim

[11] Patent Number: 6,128,438

[45] Date of Patent: Oct. 3, 2000

[54] INFLAMMABLE CLEANING FLUID HEATING APPARATUS

[75] Inventor: Song Il Kim, Pusan, Rep. of Korea

[73] Assignee: Il Woo Engineering Co., Ltd., Pusan, Rep. of Korea

[21] Appl. No.: 09/164,240

[22] Filed: Sep. 30, 1998

[30] Foreign Application Priority Data

Dec. 26, 1997 [KR] Rep. of Korea ..... 97-82649
Apr. 29, 1998 [KR] Rep. of Korea ..... 98-7350

[51] Int. Cl.[7] ..... F24H 1/20

[52] U.S. Cl. ..... 392/447; 392/456; 392/496; 134/105

[58] Field of Search ..... 392/346, 441, 392/447, 456, 461, 462, 465, 470, 474, 477, 496, 503; 219/430, 432, 436, 437, 438, 439, 441, 442; 134/105, 106, 107, 108

[56] References Cited

U.S. PATENT DOCUMENTS

| | | | |
|---|---|---|---|
| 2,036,815 | 4/1936 | Leader | 392/496 |
| 2,994,514 | 8/1961 | Brown | 392/447 |
| 3,468,292 | 9/1969 | Ferraro et al. | 392/496 |
| 3,629,552 | 12/1971 | Edging | 392/447 |
| 3,747,206 | 7/1973 | Pease | 392/503 |
| 4,246,466 | 1/1981 | Rice et al. | 392/496 |
| 4,286,141 | 8/1981 | MacCracken | 392/346 |
| 4,462,415 | 7/1984 | Otzen | 134/111 |
| 4,469,935 | 9/1984 | Candela | 392/496 |
| 4,617,456 | 10/1986 | Richards et al. | 392/503 |
| 4,641,012 | 2/1987 | Roberts | 392/496 |
| 5,265,633 | 11/1993 | Knowlton | 134/111 |
| 5,303,725 | 4/1994 | Hilgren | 134/56 R |
| 5,322,078 | 6/1994 | Tuttle | 134/104.4 |
| 5,437,002 | 7/1995 | Bennett | 392/441 |
| 5,649,557 | 7/1997 | Usher | 134/107 |
| 5,808,277 | 9/1998 | Dosani et al. | 392/441 |
| 5,838,879 | 11/1998 | Harris | 392/496 |
| 5,930,459 | 7/1999 | Eckman et al. | 392/503 |

FOREIGN PATENT DOCUMENTS

| | | | |
|---|---|---|---|
| 3045121A1 | 7/1982 | Germany | 392/451 |
| 58-117952A | 7/1983 | Japan | 392/451 |
| 62-33256A | 2/1987 | Japan | 392/451 |
| 3-207960A | 9/1991 | Japan | 392/451 |
| 4-281155A | 10/1992 | Japan | 392/451 |

*Primary Examiner*—Teresa Walberg
*Assistant Examiner*—Fadi H. Dahbour
*Attorney, Agent, or Firm*—Marshall, O'Toole, Gerstein, Murray & Borun

[57] ABSTRACT

Inflammable cleaning fluid heating apparatus are disclosed. The disclosed apparatus safely heat a cleaning fluid such as an inflammable solvent to a predetermined temperature. One of the disclosed inflammable cleaning fluid heating apparatus includes a main body for storing a heat transfer oil; a heater mounted inside the main body for heating the heat transfer oil; a cleaning fluid path mounted inside the main body having an inlet and an outlet; a temperature sensor for sensing a temperature of the heat transfer oil; and a controller for selectively switching the heater between anon state and an off state.

11 Claims, 7 Drawing Sheets

INFLAMMABLE CLEANING FLUID HEATING APPARATUS

FIELD OF THE INVENTION

The present invention relates generally to heating apparatus, and more particularly, to a heating apparatus which heats an inflammable cleaning fluid for use in washing various parts of industrial machines at predetermined temperature(s) without risk of ignition or fire.

BACKGROUND OF THE INVENTION

Generally, inflammable cleaning fluid(s) are often used to wash various parts for use in various industrial fields (e.g., automobile repair and the like). Such parts washers often store a cleaning fluid such as a solvent in a cleaning fluid storage receptacle. Such parts washers also often include a pump to supply and spray the cleaning fluid onto and/or into parts disposed in an upper wash basin, so that the parts can be washed.

However, such prior art parts washers suffer from certain disadvantages when employed with cleaning fluid. More specifically, the washing effectiveness of the typical cleaning fluid is reduced at low temperatures, for example, at 0° C. or below. For this reason, the washing effectiveness is reduced when the cleaning fluid is used in winter and/or in the northern hemisphere. Furthermore, if the cleaning fluid is used at a low temperature, the hands of a worker often become cold due to the cold cleaning fluid, thereby causing inconvenience in washing the parts. For the foregoing reasons, it is necessary to heat the cleaning fluid to at least a predetermined temperature. However, since most available cleaning fluids are inflammable, heating the cleaning fluid with known apparatus may result in ignition of the fluid thereby creating the risk of fire. Heretofore, it has therefore, been difficult to safely heat cleaning fluid to a desired temperature.

SUMMARY OF THE INVENTION

In accordance with an aspect of the invention, an inflammable cleaning fluid heating apparatus is provided. The apparatus includes a main body for storing a heat transfer oil; a heater mounted inside the main body, for heating the heat transfer oil; a cleaning fluid path mounted inside the main body and having an inlet and an outlet; a temperature sensor for sensing a temperature of the heat transfer oil; and a controller cooperating with the temperature sensor to selectively switch the heater between an on state and an off state.

In some embodiments, the inflammable cleaning fluid heating apparatus further includes a preheating pipe mounted to and extending from the main body. The preheating pipe circulates the heat transfer oil.

In some embodiments, the cleaning fluid path has a coil shape at a position where the heat transfer oil is heat-exchanged with a cleaning fluid passing through the path.

In some embodiments, the inflammable cleaning fluid heating apparatus is further provided with a valve mounted in the inlet of the cleaning fluid path to selectively permit flow of the cleaning fluid into the path.

Preferably, the heat transfer oil is a base oil refined from a crude oil.

In accordance with another aspect of the invention, an inflammable cleaning fluid heating apparatus is provided. The apparatus comprises a heater for directly heating a cleaning fluid; a heater temperature sensor mounted near the heater for sensing a temperature of the heater; a cleaning fluid temperature sensor mounted a distance away from the heater for sensing a temperature of the cleaning fluid; and a controller in communication with the heater temperature sensor and the cleaning fluid temperature sensor for selectively switching the heater between an on state and an off state. Specifically, if at least one of the cleaning fluid and the heater is heated above a predetermined threshold temperature, the controller switches the heater to the off state. If on the other hand, both the sensed cleaning fluid temperature and the sensed heater temperature fall below the predetermined threshold temperature, the controller switches the heater to the on state.

In some embodiments, the inflammable cleaning fluid heating apparatus is further provided with a heater cover in which the heater is mounted and a heat transfer element is charged.

Other features and advantages are inherent in the apparatus claimed and disclosed or will become apparent to those skilled in the art from the following detailed description and its accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

First Embodiment

Figure 1:
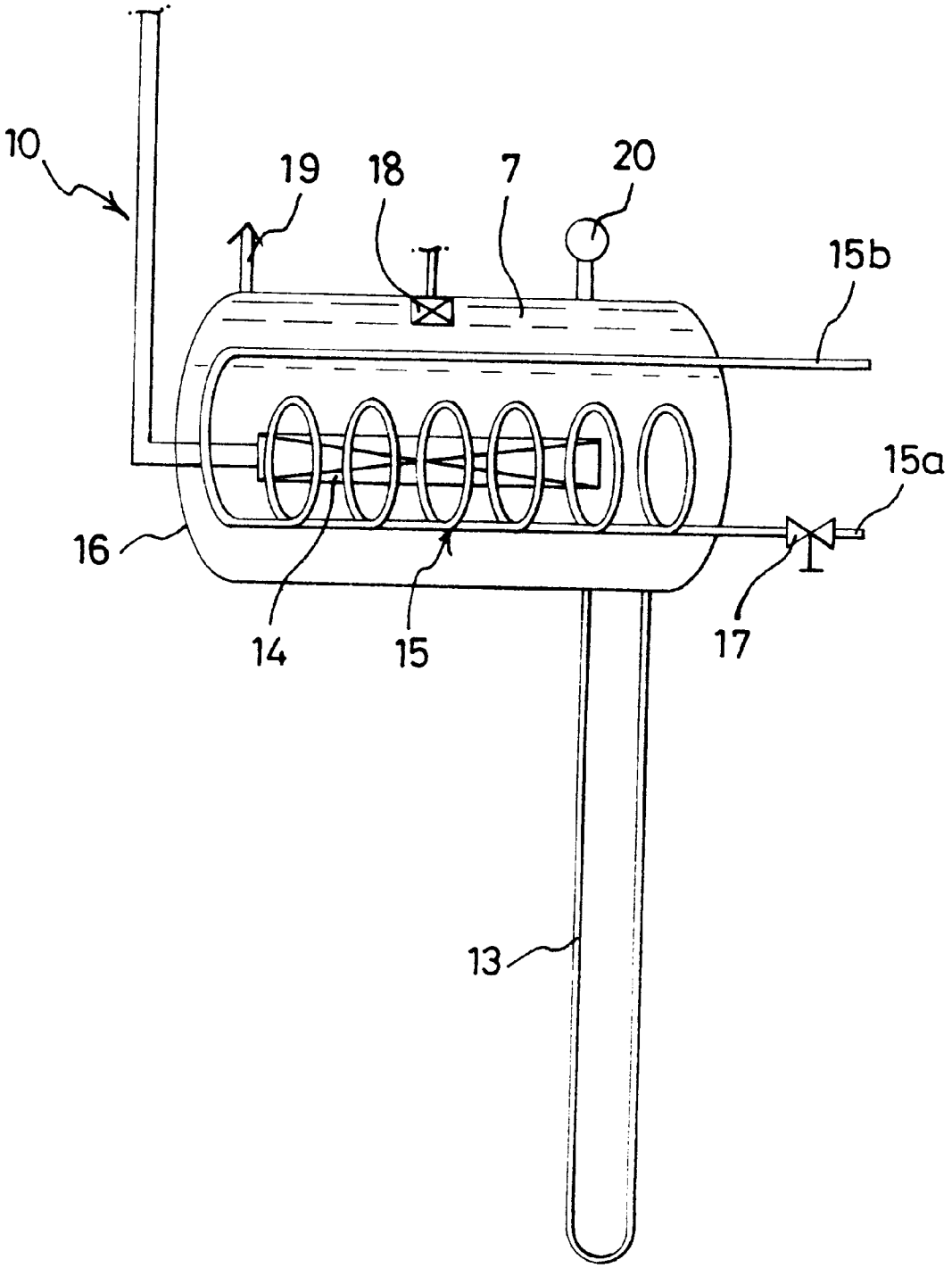
FIG. 1 is a schematic view illustrating a first representative inflammable cleaning fluid heating apparatus constructed in accordance with the teachings of the present invention.

An inflammable cleaning fluid heating apparatus 10 constructed in accordance with the teachings of the present invention is shown in FIG. 1. In this embodiment of the present invention, it is intended that an inflammable solvent, (i.e., a cleaning fluid) is not directly heated, but instead is indirectly heated through a heat transfer oil so as to safely heat the cleaning fluid to a predetermined temperature or above.

As shown in FIG. 1, the inflammable cleaning fluid heating apparatus 10 of the present invention includes a main body 16 for storing a heat transfer oil 7, a heater 14 mounted inside the main body 16 for heating the heat transfer oil 7, a cleaning fluid path 15 mounted inside the main body 16, having an inlet 15*a* and an outlet 15*b*, a temperature sensor 18 mounted inside the main body 16 for sensing a temperature of the heat transfer oil 7, and a conventional controller such as a microprocessor or some other logic circuit (see FIG. 5) for selectively switching the heater 14 between an on state and an off state according to the sensed temperature of the heat transfer oil 7.

More specifically, the heater 14 for heating the heat transfer oil 7 is mounted inside the main body 16. The temperature sensor 18 is mounted in the main body 16 to sense the temperature of the heat transfer oil 7. The sensor 18 cooperates with the logic circuit noted above to stop the operation of the heater 14 if the temperature of the heat transfer oil 7 reaches or exceeds a predetermined temperature. The cleaning fluid path 15 is also mounted within the main body 16 and has an inlet 15*a* for inflow of the cleaning fluid and an outlet 15*b* for outflow of the cleaning fluid. Preferably, a valve 17 is mounted at either the inlet 15*a* or the outlet 15*b*, (preferably at one side of the inlet 15*a*), so as to selectively permit or prevent flow of the cleaning fluid through the path 15. A preheating pipe 13 which circulates the heat transfer oil 7 is preferably mounted at one side of the main body 16.

In order to inject or exhaust the heat transfer oil 7 into or from the main body 16, and to exhaust air from the main body 16, a vent 19 is preferably mounted in the main body 16. Additionally, to allow a user to view the temperature of the heat transfer oil 7 from outside the main body 16, the apparatus 10 is provided with a thermometer 20.

As will be appreciated by persons of ordinary skill in the art, a base oil refined by a conventional crude oil refining process at high purity is preferably used as the heat transfer oil 7. Such a base oil is preferred because it has good heat stability, is susceptible to use in a wide temperature range (e.g., between −20° C. and 320° C.), and because such oil has low viscosity so that a high heat transfer coefficient can be achieved. In addition, the noted base oil is also preferably used as the heat transfer oil 7 because such oil has no erosion property and it is not harmful to the human body.

In the preferred embodiment, the heater 14 is an electrical heater that generates heat by electric resistance. Preferably, the cleaning fluid path 15 is made of a copper material to improve the heat transfer efficiency. The fluid path 15 preferably has a section with a coil shape.

Figure 2:
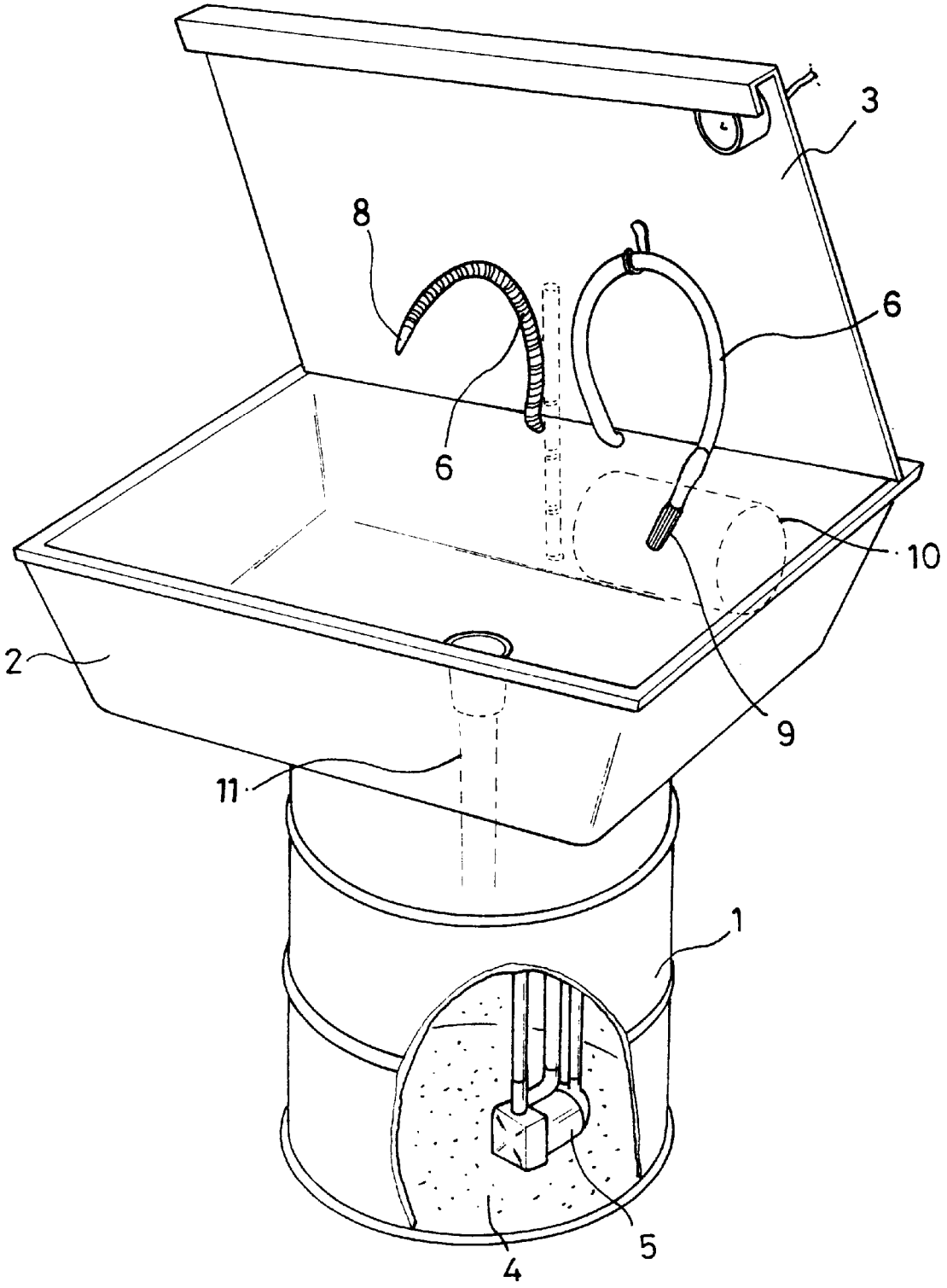
FIG. 2 is a perspective view illustrating a parts washer to which the inflammable cleaning fluid heating apparatus of FIG. 1 is applied.
Figure 3:
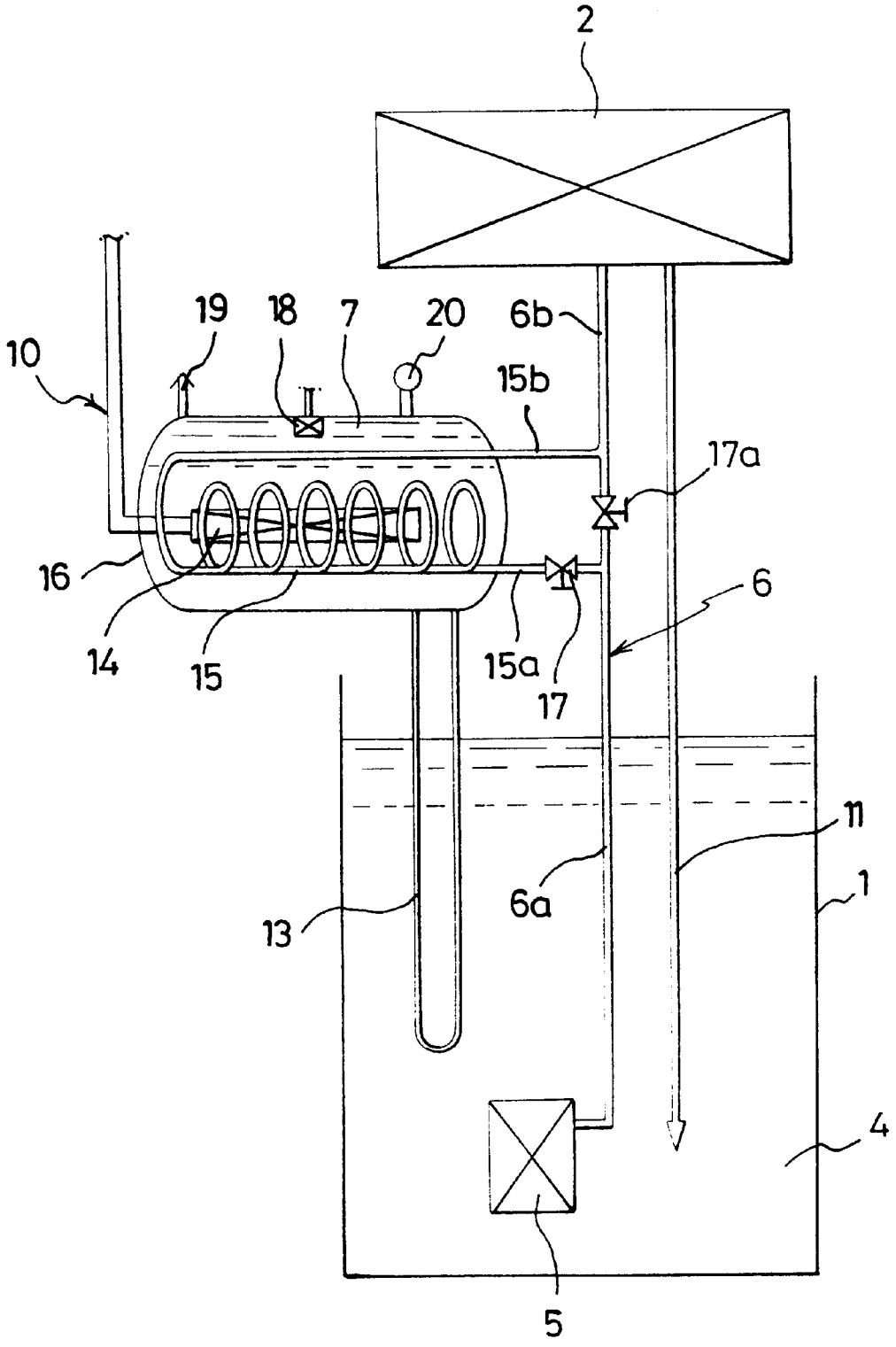
FIG. 3 is a sectional view of the a parts washer and the inflammable cleaning fluid heating apparatus of FIGS. 1 and 2.

The operation of the inflammable cleaning fluid heating apparatus 10 will be described with reference to FIGS. 2 and 3. A representative parts washer to which the inflammable cleaning fluid heating apparatus 10 can be applied is shown in FIGS. 2 and 3. The parts washer is known and will be schematically described below.

As shown in FIG. 2, a wash basin 2 is mounted on a cleaning fluid storage receptacle 1 for storing the cleaning fluid 4. When desired, the parts to be washed are placed in the basin 2. A basin cover 3 is hingedly coupled to one end of the basin 2 such that it can be opened and closed, as desired.

A pump 5 is mounted in the cleaning fluid storage receptacle 1 to pump the cleaning fluid 4 to the basin 2. A wash hose 6 is coupled to the pump 5. The wash hose 6 guides the cleaning fluid 4 to the basin 2. Either a nozzle 8 or a brush 9 is mounted at one end of the wash hose 6 to either spray the cleaning fluid or to wash mechanical parts more effectively as the application requires.

An exhaust pipe 11 is mounted at the bottom of the basin 2. It extends to the cleaning fluid storage receptacle 1. The exhaust pipe 11 returns the cleaning fluid sprayed from the hose 6 to the cleaning fluid storage receptacle 1 where it is reused. The preheating pipe 13 of the inflammable cleaning fluid heating apparatus 10 is immersed in the cleaning fluid storage receptacle 1.

The inflammable cleaning fluid heating apparatus 10 is coupled to a predetermined portion of the wash hose 6 of the aforementioned parts washer. It is possible to fixably or detachably mount the inflammable cleaning fluid heating apparatus 10 at the rear of either the cleaning fluid storage receptacle 1 or the basin 2.

As shown in FIG. 3, the inlet 15*a* of the cleaning fluid path of the inflammable cleaning fluid heating apparatus 10 is coupled to a lower section 6*a* of the wash hose 6. The outlet 15*b* of the cleaning fluid path 15 is coupled to an upper section 6*b* of the wash hose 6. The lower section 6*a* of the hose 6 is connected to the pump 15. The upper section 6*b* of the hose 6 is coupled to the nozzle. Preferably, an auxiliary valve 17*a* is mounted at a predetermined position of the wash hose 6, that is, between the T-coupling for coupling the inlet 15*a* of the inflammable cleaning fluid heating apparatus 10 with the wash hose 6 and the T-coupling for coupling the outlet 15*b* of the inflammable cleaning fluid heating apparatus 10 with the wash hose 6. The auxiliary valve 17*a* can be adjusted to selectively open or close the hose 6 to permit flow of the cleaning fluid past the apparatus 10. Specifically, when it is not necessary to heat the cleaning fluid 4, (for example, in summer), the auxiliary valve 17*a* is opened and the valve 17 mounted in the inflammable cleaning fluid heating apparatus 10 is closed so that the cleaning fluid 4 flows to the nozzle 8 through the wash hose 6 directly without heating. However, when it is necessary to heat the cleaning fluid 4, (for example, in winter), the auxiliary valve 17*a* is closed and the valve 17 mounted in the inflammable cleaning fluid heating apparatus 10 is opened so that the cleaning fluid 4 flows to the nozzle 8 after passing through the inflammable cleaning fluid heating apparatus 10 and being heated to a predetermined temperature.

In operation, power from a power source is supplied to the inflammable cleaning fluid heating apparatus 10 and the heater 14 operates to heat the heat transfer oil 7. The heated heat transfer oil 7 is then heat-exchanged with the cleaning fluid flowing through the cleaning fluid path 15 so that the cleaning fluid is heated to a predetermined temperature and then supplied to the nozzle 8. Preferably, at least a section of the cleaning fluid path 15 has a coil shape so that the heat transfer area becomes large, and a more efficient heat exchange can be performed between the heat transfer oil 7 and the cleaning fluid.

The predetermined temperature is selected to be a temperature below the natural ignition point of the cleaning fluid. In case of a typical solvent, about 150° C. is a safe predetermined temperature, even if 200° C. is possible.

If the heat transfer oil 7 reaches or exceeds the predetermined temperature, the temperature sensor 18 cooperates with the logic circuit to stop the heater 14. As a result, the temperature of the cleaning fluid is limited to a safe level and the cleaning fluid is prevented from being ignited by excessive temperature increases.

Since the preheating pipe 13 of the inflammable cleaning fluid heating apparatus 10 is immersed in the cleaning fluid storage receptacle 1, the heated heat transfer oil 7 circulating in the preheating pipe 13 causes the temperature of the cleaning fluid 4 in the cleaning fluid storage receptacle 1 to increase. This has the beneficial effect of reducing the preheating time of the pump 5.

As aforementioned, the disclosed inflammable cleaning fluid heating apparatus 10 has at least the following advantages. Since it is possible to heat the cleaning fluid such as an inflammable solvent to a predetermined temperature without risk of ignition or fire, the cleaning fluid can be efficiently employed to wash parts. In addition, if the inflammable cleaning fluid heating apparatus 10 is used with a parts washer, it is possible to exercise a function of the cleaning fluid, thereby improving efficiency of washing.

Second Embodiment

Since the inflammable cleaning fluid heating apparatus 10 discussed above adopts an indirect heating method, the heat transfer oil can become frozen at extremely low temperatures, (for example, below −20° C.). Such freezing will impede or prevent heating of the cleaning fluid. To avoid this result, a second inflammable cleaning fluid heating apparatus 30 can be employed which adopts a direct heating method. In this second embodiment 30, the cleaning fluid is directly heated with safety.

Figure 4:
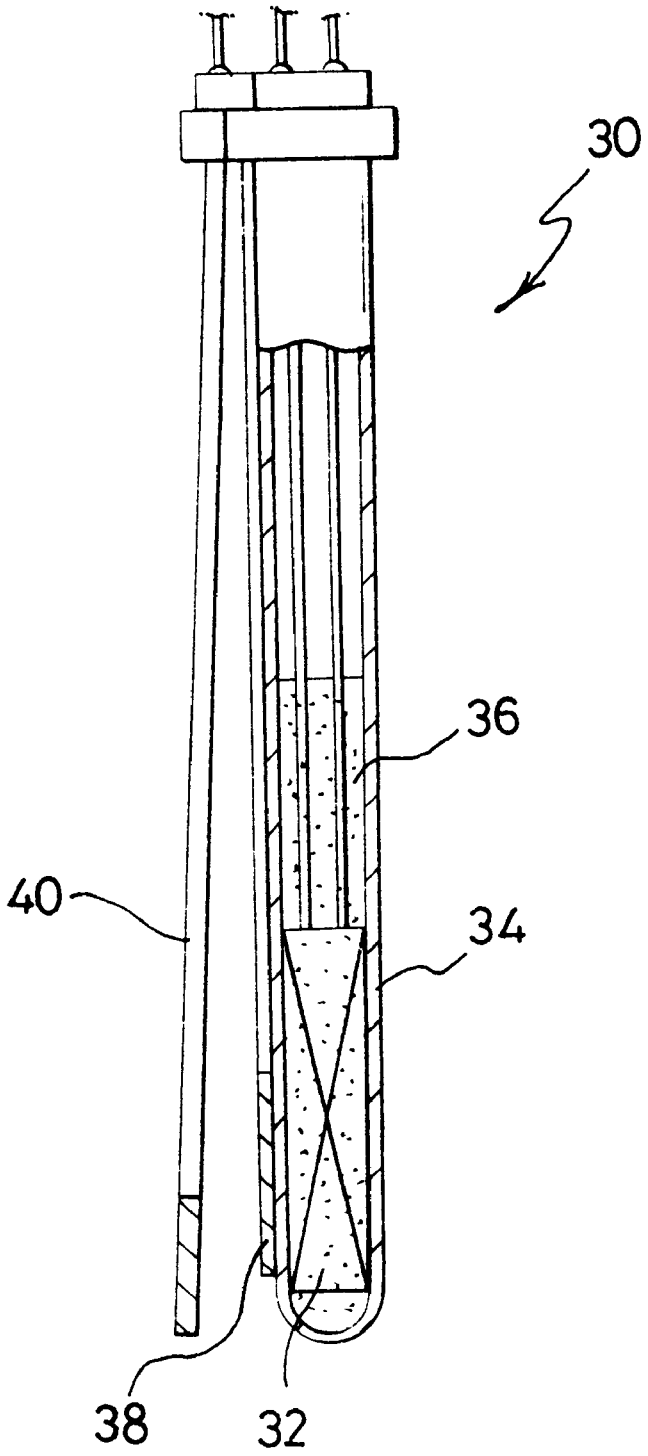
FIG. 4 is a schematic view illustrating a second representative inflammable cleaning fluid heating apparatus constructed in accordance with the teachings of the present invention.

FIG. 4 is a schematic view illustrating the second inflammable cleaning fluid heating apparatus 30. As shown in FIG. 4, the inflammable cleaning fluid heating apparatus 30 includes a heater 32 for directly heating the cleaning fluid, a heater temperature sensor 38 mounted at one side of the heater 32 for sensing the temperature of the heater 32, a cleaning fluid temperature sensor 40 mounted at a distance from the heater 32 for sensing the temperature of the cleaning fluid, and a controller 60 (FIG. 5) for selectively operating or stopping the heater 32 in response to temperature changes in the heater 32 and/or in the cleaning fluid as explained below.

As with apparatus 10, the heater 32 preferably generates heat by electrical resistance. If the heater 32 is in direct contact with the cleaning fluid, the heater 32 may be eroded by the cleaning fluid and leakage current may occur. For this reason, the heater 32 is preferably mounted in a heater cover 34 in which a heat transfer element 36 such as magnesia is charged. Then, heat generated by the heater 32 is transferred to the cleaning fluid through the heat transfer element 36 so that a uniform heat transfer can be achieved.

To avoid the above mentioned problems associated with direct contact between the heater 32 and the cleaning fluid, a material which is not eroded when contacting the cleaning fluid and which has good heat conductivity is preferably used as the heater cover 34. By way of example, not limitation, stainless steel may preferably be used as the heater cover 34.

To optimize heat efficiency, the heater 32 preferably generates heat at a portion which is in contact with the cleaning fluid and does not generate heat at a portion which is not in contact with the cleaning fluid.

The heater temperature sensor 38 is provided for sensing a temperature of a heating portion of the heater 32, more exactly, for sensing a surface temperature of the heater cover 34. If the heater temperature sensor 38 senses that the surface temperature of the heater cover 34 has reached or exceeded a predetermined temperature, the logic circuit or controller 60 stops the operation of the heater 32. In addition, a separate cleaning fluid temperature sensor 40 is provided for sensing a temperature of the cleaning fluid. These sensors 38 and 40 serve as redundant protection against overheating and fire. That is, if either the surface temperature of the heater cover 34 or the temperature of the cleaning fluid reaches or exceeds a predetermined temperature, the controller 60 turns off the heater 32.

Figure 5:
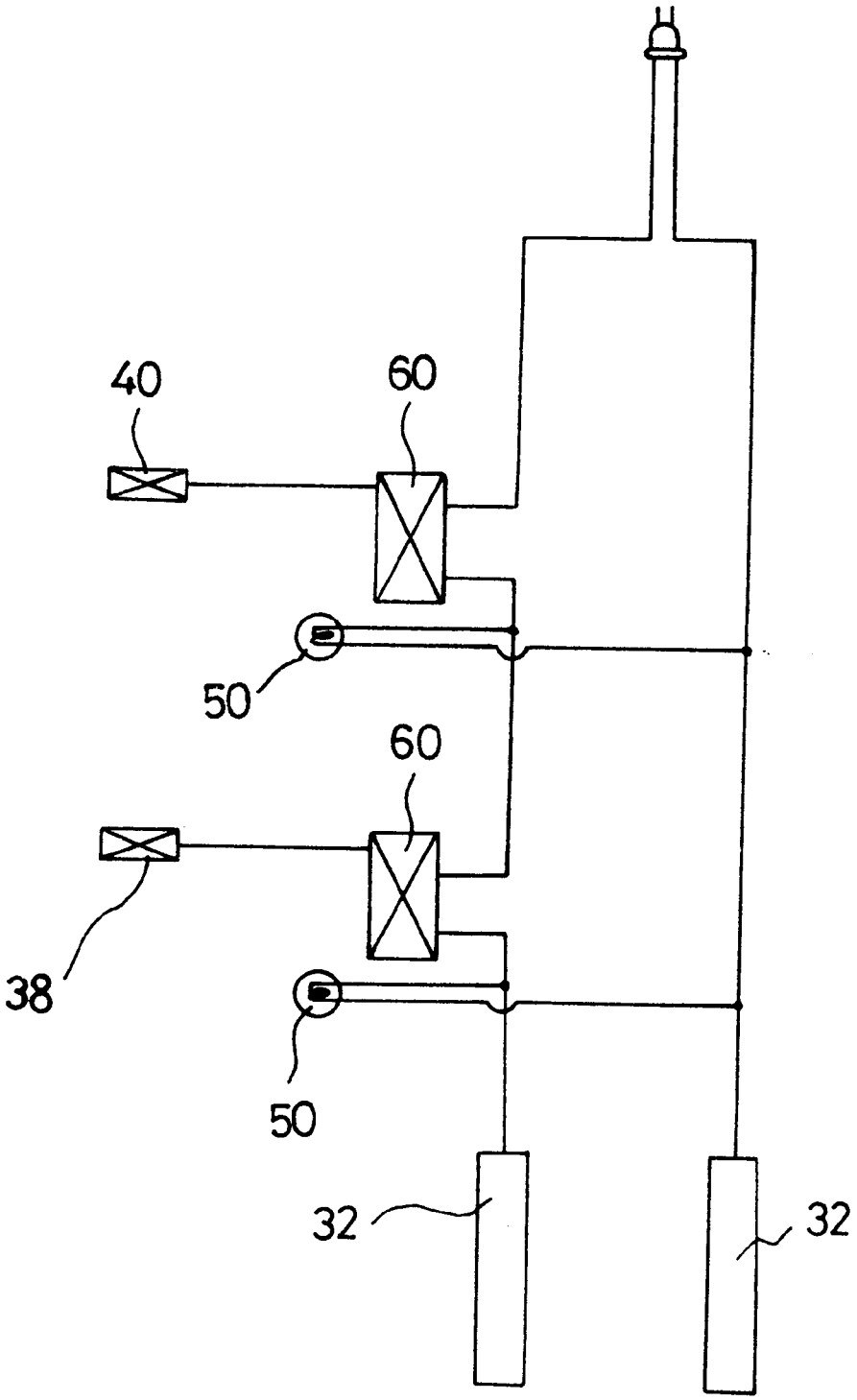
FIG. 5 is a schematic view illustrating a circuit configuration of the inflammable cleaning fluid heating apparatus shown in FIG. 4.

A circuit configuration of the inflammable cleaning fluid heating apparatus 30 is shown in FIG. 5. As shown in FIG. 5, the heater 32 is electrically connected with the heater temperature sensor 38, the cleaning fluid temperature sensor 40 and the controller 60 to control the operation of the heater 32.

In view of the fact that the ignition temperature of various cleaning fluids differ, the controller 60 is preferably programmable so that a user can set a heating temperature of the heater 32 at a predetermined value that is appropriate for the cleaning fluid being heated. In order to provide a visual indication of the operation state of the inflammable cleaning fluid heating apparatus 30, an operating lamp 50 is connected to the circuit as shown in FIG. 5. As also shown in FIG. 5, a plurality of heaters 32 and controllers 60 may be connected, if desired.

As will be appreciated by persons of ordinary skill in the art, the function of the circuit configuration as shown in FIG. 5 can be realized by a wide variety of conventional circuits without departing from the scope or spirit of the invention. As will also be appreciated by those of skill in the art, several types of sensors and controllers can be used to implement the sensors 38, 40 and the controller 60, respectively, without departing from the scope or spirit of the invention. However, in one implementation, a capillary thermostat implements the sensor 38 and the controller 40.

Figure 6:
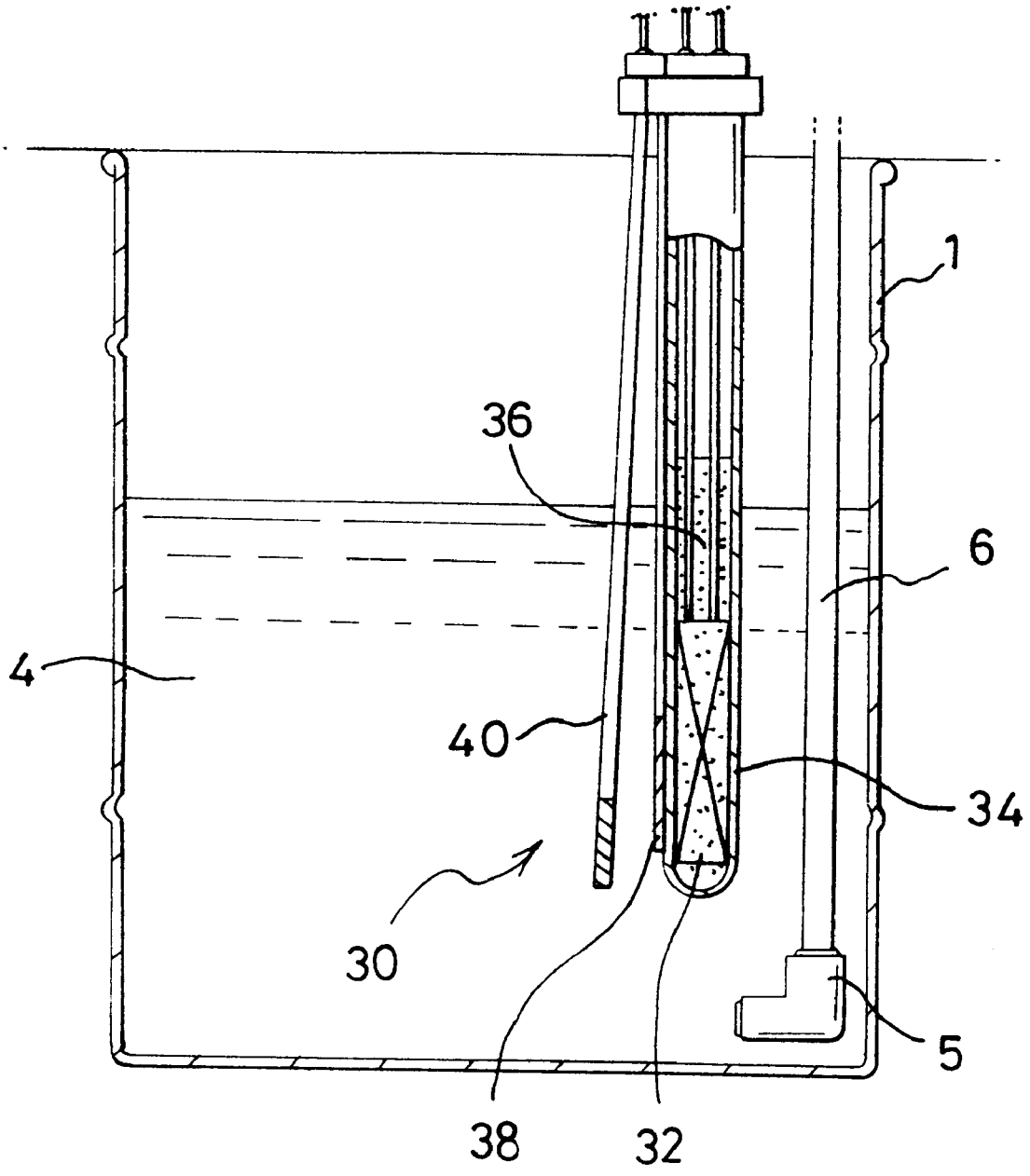
FIG. 6 is a sectional view illustrating a parts washer to which the inflammable cleaning fluid heating apparatus of FIG. 4 is applied.

The operation of the inflammable cleaning fluid heating apparatus 30 will now be described with reference to FIG. 6. Specifically, when the heater 32 is operated, the heat generated by the heater 32 is transferred to the cleaning fluid 4 through the heat transfer element 36 and the heater cover 34. As a result, the temperature of the cleaning fluid 4 rises. If the surface temperature of the heater cover 34 reaches or exceeds a predetermined temperature (i.e., a surface temperature which is preferably below a temperature capable of igniting the cleaning fluid), the heater temperature sensor 38 cooperates with the controller 60 to stop the operation of the heater 32. If the surface temperature of the heater cover 34 subsequently falls below the predetermined temperature, the controller 60 re-starts the heater 32 so as to again heat the cleaning fluid 4.

Additionally, if the temperature of the cleaning fluid 4 is heated above a predetermined temperature, the cleaning fluid temperature sensor 40 and the controller 60 cooperate to stop the operation of the heater 32. In other words, in this embodiment 30, the temperature of the cleaning fluid 4 and the surface temperature of the heater cover 34 are sensed, and the operation of the heater 32 stops if either of the sensed temperatures reaches or exceeds one or more predetermined temperature(s).

In addition to the advantages of the first inflammable cleaning fluid apparatus 10 discussed above, the second inflammable cleaning fluid heating apparatus 30 is advantageous in that its direct heating method achieves superior heat transfer efficiency as compared to the indirect heating method of the first embodiment 10.

Figure 7:
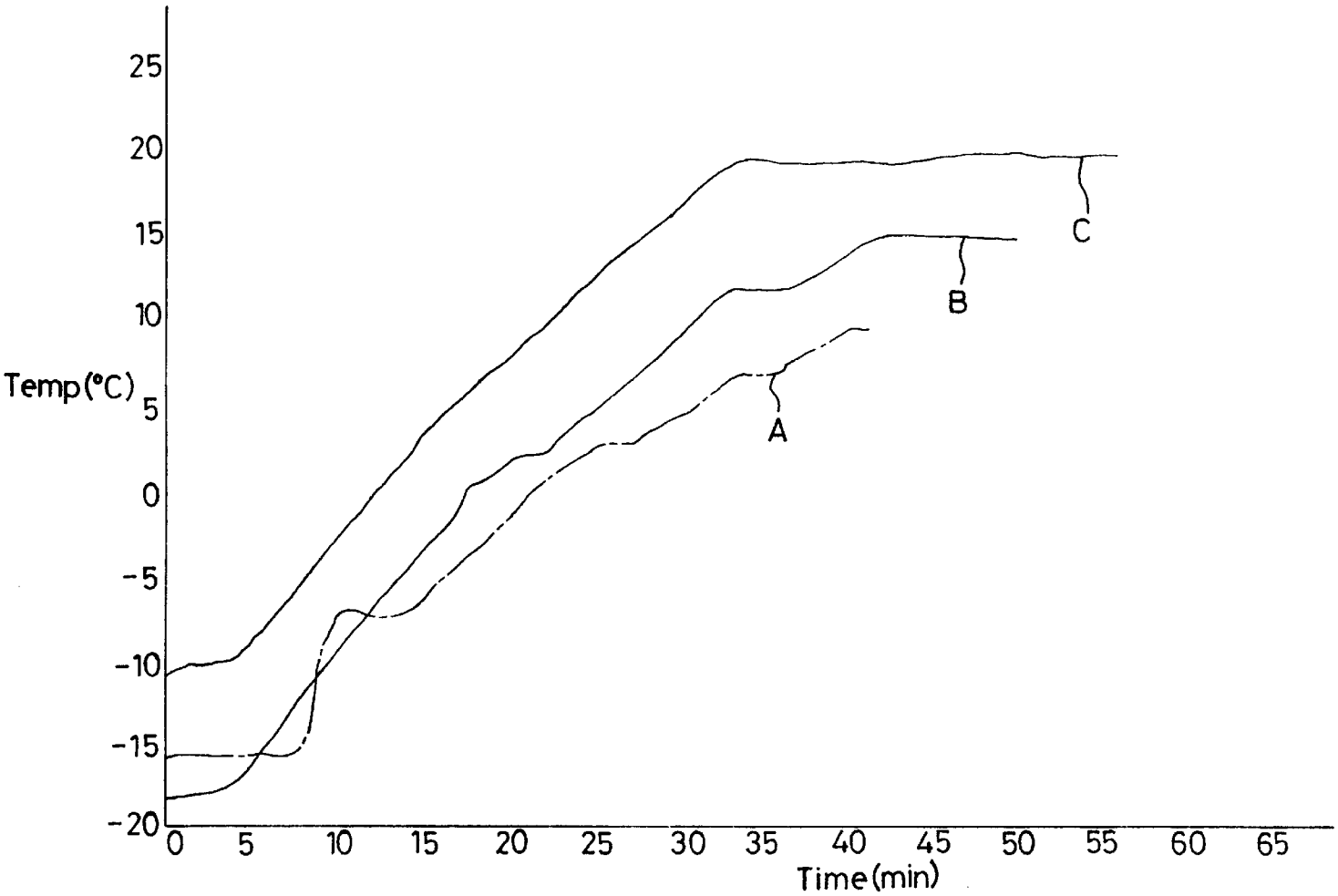
FIG. 7 is a graphical illustration of test results associated with the apparatus shown in FIGS. 1–6.

FIG. 7 shows test results for the first and second apparatus 10, 30 discussed above. More specifically, in FIG. 7, graph 'A' is representative of the results of a test performed on an apparatus 10 employing the indirect heating method discussed above in which the cleaning fluid was heated from −15.7° C. to 9.5° C. with the atmospheric temperature between −19° C. and −14° C. According to the test results, the heat efficiency achieved is about 1.79 min/° C.

In FIG. 7, graph 'B' is representative of the results of a test performed on an apparatus 30 employing the direct heating method discussed above. As shown by graph 'B', the cleaning fluid was heated from −18° C. to 15° C. with the atmospheric temperature between −20° C. and −19° C.

According to the test results, the heat efficiency achieved is about 1.125 min/° C.

Also in FIG. 7, graph 'C' is representative of the results of a test performed on an apparatus 30 employing the direct heating method. As shown in graph 'C', the cleaning fluid was heated from −10° C. to 18° C. with the atmospheric temperature between −22° C. and −17° C. According to the test results, the heat efficiency achieved is about 1.142 min/° C.

In the aforementioned tests, the heater is automatically switched on and off repeatedly to maintain a desired temperature. As a result, power consumption is very low once the temperature of the cleaning fluid reaches the desired predetermined temperature.

Although the inflammable cleaning fluid heating apparatus 10, 30 have been discussed in connection with parts washers, they may be used with other apparatuses for the purpose of heating an inflammable fluid such as a solvent to a desired temperature without risk of ignition. For example, they may be used in a tank lorry heating apparatus for heating inflammable fluid stored in a tank lorry and/or in a heating apparatus for heating a petrochemistry material flowing in a drainpipe. In the tank lorry application, a thermal insulation material is used in the tank so as not to freeze an inflammable material stored therein. However, in this case, high cost is incurred in mounting the thermal insulation material, and the thermal insulation material does not prevent freezing of the inflammable material at atmospheric temperatures below approximately −10° C. Alternatively, a steam pipe may be used in a tank. In this case, high costs are incurred in mounting the steam pipe, heat efficiency is reduced, and rust or scale may occur due to the steam. However, the disclosed inflammable cleaning fluid heating apparatus 10, 30 have the advantages that the inflammable material in the tank can efficiently be heated at low cost without risk of fire.

Those skilled in the art will further appreciate that, although the invention has been described in connection with certain embodiments, there is no intent to limit the invention thereto. On the contrary, the intention of this application is to cover all modifications and embodiments fairly falling within the scope of the appended claims either literally or under the doctrine of equivalents.

What is claimed is:

1. An inflammable cleaning fluid heating apparatus comprising:

a storage receptacle storing an inflammable cleaning fluid having a natural ignition point;

a wash basin;

a hose;

a main body for storing a heat transfer oil;

a heater mounted inside the main body for heating the heat transfer oil;

a cleaning fluid path mounted inside the main body and being in fluid communication with the hose;

a pump for delivering the inflammable cleaning fluid from the storage receptacle to the wash basin via the hose and the cleaning fluid path;

a temperature sensor for sensing a temperature of the heat transfer oil; and a controller cooperating with the temperature sensor and the heater to selectively switch the heater between an on state and an off state to maintain the temperature of the heat transfer oil below the natural ignition point of the cleaning fluid.

2. An inflammable cleaning fluid heating apparatus as defined in claim 1 further comprising a preheating pipe mounted to and extending from the main body and into the storage receptacle to heat the cleaning fluid in the storage receptacle, the preheating pipe circulating the heat transfer oil.

3. An inflammable cleaning fluid heating apparatus as defined in claim 1 wherein the cleaning fluid path has a coil shape at a position where the heat transfer oil is heat-exchanged with a cleaning fluid passing through the path.

4. An inflammable cleaning fluid heating apparatus as defined in claim 1 further comprising a valve mounted in the inlet of the cleaning fluid path to selectively permit flow of the cleaning fluid into the cleaning fluid path.

5. An inflammable cleaning fluid heating apparatus as defined in claim 1 wherein the heat transfer oil is a base oil refined from a crude oil.

6. An inflammable cleaning fluid heating apparatus as defined in claim 1 further comprising at least one valve for diverting the cleaning fluid away from the cleaning fluid path and through the hose when heating of the cleaning fluid with the heater is undesired.

7. An inflammable cleaning fluid heating apparatus comprising:

a storage receptacle storing an inflammable cleaning fluid having a natural ignition point;

a wash basin;

a hose for delivering the inflammable cleaning fluid from the storage receptacle to the wash basin;

a heater positioned within the storage receptacle for directly heating the inflammable cleaning fluid;

a heater temperature sensor operatively engaging the heater for sensing a temperature of the heater;

a cleaning fluid temperature sensor mounted a distance away from the heater for sensing a temperature of the cleaning fluid; and a controller in communication with the heater temperature sensor and the cleaning fluid temperature sensor for selectively switching the heater between an on state and an off state, whereby if at least one of: (a) the cleaning fluid is heated above a first predetermined threshold temperature below the natural ignition point and (b) the heater is heated above a second predetermined threshold temperature below the natural ignition point, the controller switches the heater to the off state to maintain the temperature of the cleaning fluid below its natural ignition point, and if the sensed cleaning fluid temperature falls below the first predetermined threshold temperature and the sensed heater temperature falls below the second predetermined threshold temperature, the controller switches the heater to the on state.

8. An inflammable cleaning fluid heating apparatus as defined in claim 6 further comprising a heater cover in which the heater is mounted and a heat transfer element is charged.

9. An inflammable cleaning fluid heating apparatus as defined in claim 7 wherein the heater temperature sensor is mounted on the heater cover and the heater temperature sensor operatively engages the heater via the heater cover.

10. An inflammable cleaning fluid heating apparatus as defined in claim 6 wherein the first and second predetermined threshold temperatures are different.

11. An inflammable cleaning fluid heating apparatus as defined in claim 6 wherein the first and second predetermined threshold temperatures are identical.

* * * * *

UNITED STATES PATENT AND TRADEMARK OFFICE

CERTIFICATE OF CORRECTION

PATENT NO. : 6,128,438

DATED : October 3, 2000

INVENTOR(S) : Song Il Kim

It is certified that error appears in the above-identified patent and that said Letters Patent is hereby corrected as shown below:

Col. 8, Line 12 after "...a valve mounted in...", please delete "the", and insert -- an --.

Signed and Sealed this

Twenty-second Day of May, 2001

*Attest:*

NICHOLAS P. GODICI

*Attesting Officer*

*Acting Director of the United States Patent and Trademark Office*